US009289877B2

(12) United States Patent
Schafer et al.

(10) Patent No.: US 9,289,877 B2
(45) Date of Patent: Mar. 22, 2016

(54) DEVICE FOR THE FINE MACHINING OF OPTICALLY ACTIVE SURFACES ON, IN PARTICULAR, SPECTACLE LENSES

(75) Inventors: Holger Schafer, Weilmunster (DE); Steffen Wallendorf, Wetzlar-Dutenhofen (DE); Udo Fiedler, Lahnau/Dorlar (DE)

(73) Assignee: Satisloh AG, Baar (CH)

( * ) Notice: Subject to any disclaimer, the term of this patent is extended or adjusted under 35 U.S.C. 154(b) by 285 days.

(21) Appl. No.: 14/003,117

(22) PCT Filed: Mar. 15, 2012

(86) PCT No.: PCT/EP2012/001153

§ 371 (c)(1),
(2), (4) Date: Sep. 4, 2013

(87) PCT Pub. No.: WO2012/123120

PCT Pub. Date: Sep. 20, 2012

(65) Prior Publication Data

US 2013/0344778 A1 Dec. 26, 2013

(30) Foreign Application Priority Data

Mar. 17, 2011 (DE) ..... 10 2011 014 230

(51) Int. Cl.
*B24B 41/053* (2006.01)
*B24B 13/02* (2006.01)
(Continued)

(52) U.S. Cl.
CPC ..... *B24B 41/053* (2013.01); *B24B 13/023* (2013.01); *B24B 27/0076* (2013.01); *B24B 41/02* (2013.01); *B24B 41/04* (2013.01)

(58) Field of Classification Search
CPC B24B 13/023; B24B 27/0076; B24B 41/053; B24B 41/04; B24B 41/02
USPC ..... 451/294
See application file for complete search history.

(56) References Cited

U.S. PATENT DOCUMENTS 4,562,671 A * 1/1986 Bouillon ..... B24B 13/005 451/388
4,653,234 A * 3/1987 Lombard ..... B24B 13/02 451/390

(Continued)

FOREIGN PATENT DOCUMENTS

DE 10 2004 062 319 B3 3/2006
JP 62120966 A2 * 6/1987

OTHER PUBLICATIONS

PCT International Preliminary Report on Patentability (English Translation), Appln. No. PCT/EP2012/001153, Filing Date: Mar. 15, 2012, Report Issued: Sep. 17, 2013, 6 pages.

(Continued)

*Primary Examiner* — Lee D Wilson
*Assistant Examiner* — Joel Crandall
(74) *Attorney, Agent, or Firm* — Reising Ethington P.C.

(57) ABSTRACT

A device for the fine machining of optically active surfaces in particular spectacle lenses, has a spindle shaft which has a tool-holder portion and is mounted in a spindle housing such that it can rotate about a tool rotation axis. The device has an electric rotary drive with a rotor and a stator that rotates the spindle shaft operatively connected to the rotor about the tool rotation axis. The tool-holder portion can be displaced axially in the direction of the tool rotation axis. The rotor and the stator parts are axially guided in a guide tube along the tool rotation axis. The spindle shaft is in the form of a hollow shaft, via which the tool-holder portion, which is configured to hold a membrane chuck, can be subjected to a fluid.

20 Claims, 8 Drawing Sheets

(51) Int. Cl.

| | |
|---|---|
| ***B24B 27/00*** | (2006.01) |
| ***B24B 41/02*** | (2006.01) |
| ***B24B 41/04*** | (2006.01) |

(56) References Cited

U.S. PATENT DOCUMENTS

| | | | | |
|---|---|---|---|---|
| 4,870,785 | A * | 10/1989 | Kotting | B24B 9/146 451/384 |
| 4,884,482 | A * | 12/1989 | Council, Jr. | B24B 13/046 451/42 |
| 5,938,381 | A | 8/1999 | Diehl et al. | |
| 5,957,756 | A | 9/1999 | Figge et al. | |
| 6,358,114 | B1 * | 3/2002 | Walker | B24B 13/015 451/158 |
| 6,796,877 | B1 * | 9/2004 | Bingham | B24B 1/00 451/147 |
| 7,066,794 | B2 | 6/2006 | Granziera et al. | |
| 7,153,184 | B2 * | 12/2006 | Kuebler | B24B 13/02 451/390 |
| 7,278,908 | B2 | 10/2007 | Urban et al. | |
| 7,396,275 | B2 | 7/2008 | Drain et al. | |
| 7,422,510 | B2 | 9/2008 | Schneider et al. | |
| 7,455,569 | B2 | 11/2008 | Schäfer et al. | |
| 7,588,480 | B2 | 9/2009 | Kuebler | |
| 7,591,710 | B2 * | 9/2009 | Drain | B24B 55/02 451/11 |
| 8,246,424 | B2 | 8/2012 | Philipps et al. | |
| 2011/0065361 | A1 | 3/2011 | Schüssler et al. | |
| 2012/0135672 | A1 | 5/2012 | Schäfer et al. | |

OTHER PUBLICATIONS

German Office Action, Application No. 10 2011 014 230.4, Filing Date: Mar. 17, 2011, Mailing Date: Jan. 19, 2012, 4 pages.

PCT International Search Report and Written Opinion, Application No. PCT/EP2012/001153, Filing Date: Mar. 15, 2012, Mailing Date: Jun. 26, 2012, 10 pages.

* cited by examiner

DEVICE FOR THE FINE MACHINING OF OPTICALLY ACTIVE SURFACES ON, IN PARTICULAR, SPECTACLE LENSES

TECHNICAL FIELD

The present invention relates generally to a device for the fine processing of optically active surfaces and in particular, to a device for fine processing the optically active surfaces of spectacle lenses such as are extensively used in so-termed "RX workshops", i.e. production shops for producing individual spectacle lenses according to prescription.

If in relation to workpieces with optically active surfaces mention is made in the following of, by way of example, "spectacle lenses", it is to be understood that reference is made to spectacle lenses not only made from mineral glass, but also spectacle lenses of all other customary materials, such as polycarbonate, CR 39, HI-Index, etc., and including plastic materials.

BACKGROUND OF THE INVENTION

The processing of optically active surfaces of spectacle lenses by machining can be roughly divided into two processing phases, namely initially the preliminary processing of the optically active surface for producing the macrogeometry according to prescription and then fine processing of the optically active surface in order to eliminate preliminary processing tracks and to obtain the desired microgeometry. Whereas preliminary processing of the optically active surfaces of spectacle lenses is carried out inter alia in dependence on the material of the spectacle lenses by grinding, milling and/or turning, the optically active surfaces of spectacle lenses in the case of fine processing are usually subjected to a fine grinding, lapping and/or polishing process, for which purpose use is made of an appropriate machine.

Manually loaded polishing machines in RX workshops are, in particular, usually constructed as "twin machines" so that advantageously the two spectacle lenses of an "RX job"—a spectacle lens specification always consists of a spectacle lens pair—can be subjected to fine processing simultaneously. Such a "twin" polishing machine is known from, for example, the specifications US-A-2007/0155286 and US-A-2007/0155287.

In this previously known polishing machine two parallelly arranged workpiece spindles, which are each rotationally driven about a respective axis of rotation, but which are otherwise stationary, project from below into a work space where two polishing tools are disposed opposite thereto, so that one polishing tool is associated with one workpiece spindle and the other polishing tool is associated with the other workpiece spindle. Each polishing tool is freely rotatable by way of a spherical bearing at a piston rod, which projects from above into the work space, of a respectively associated piston/cylinder arrangement, which is arranged above the work space and by which the respective polishing tool can be individually lowered or raised with respect to the associated workpiece spindle. The two piston/cylinder arrangements are additionally movable in common by a linear drive forward and back with respect to a front side of the polishing machine in a direction perpendicular to the axes of rotation of the workpiece spindles and, moreover, tiltable in common by a pivot drive about a pivot axis, which similarly extends perpendicularly to the axes of rotation of the workpiece spindles, but parallel to the front side of the polishing machine. The angular position between the axes of rotation of the tools and workpieces can be preset by the pivot drive before the tools are lowered by the piston/cylinder arrangements onto the workpieces. During the actual polishing process the workpieces are rotationally driven, in which case the tools disposed in processing engagement with the workpieces are rotationally trained by friction, while the linear drive ensures that the tools are moved alternately forward and back with respect to the front side of the polishing machine so that the tools continuously wipe back and forth over the workpieces with a relatively small travel (so-termed "tangential kinematics").

The advantages of this "twin" polishing machine include that it is constructed from economic components in simple manner in terms of hardware, it is very ergonomic for manual loading and, in addition, by virtue of its extremely compact, very narrow construction requires very little set-up area in the RX workshop. However, it would be desirable if other polishing methods could also be carried out on such a polishing machine. Thus, for example, the flexible polishing tools disclosed in the specifications EP-A-1 473 116, EP-A-1 698 432 and EP-A-2 014 412 are designed for polishing methods in which apart from the workpiece, also the tool itself is rotationally driven, whereby the polishing times are significantly shortened by comparison with polishing methods in which the tool is entrained merely by friction.

The polishing device disclosed in DE-A-102 50 856, (see FIGS. 5 to 9) has an electric rotary drive for the polishing tool, which as such comprises a stator and a rotor, and with a pneumatic piston/cylinder unit for axial deflection of the polishing tool along a longitudinal axis. In this regard, the arrangement of the rotary and axial drives is such that a spindle-shaft subassembly ("rotor" in the language of the above-mentioned specification), which is mounted in a housing to be rotatable about an axis of rotation and which carries the actual polishing tool at its end protruding out of the housing, is rotationally driven by way of a cogged belt drive by the electric rotary drive, which is arranged in the housing to be laterally offset parallel to the axis of rotation. The pneumatic piston/cylinder unit and an associated axial guide are, thereagainst, integrated in the spindle/shaft subassembly, consequently rotationally driven therewith, for which reason the piston/cylinder unit needs, for pressure medium feed, a compressed air rotary leadthrough. This polishing device requires a relatively large amount of installation space, for which reason it is not suitable for use in the afore-described "twin" polishing machine.

Finally, disclosed in specification DE-A-10 2009 041 442—which was published subsequently—of the same applicant is a device for fine processing of the optically active surfaces at, in particular, spectacle lenses, with a spindle shaft, which has a tool mounting section and which is mounted in a spindle housing to be rotatable about a tool axis of rotation, an electric rotary drive, which comprises a rotor and a stator and by which the spindle shaft operatively connected with the rotor is drivable to rotate about the tool axis of rotation, and an adjusting device, by which the tool mounting section is axially displaceable with respect to the spindle housing in the direction of the tool axis of rotation. A feature of this device is that the rotor and the stator are arranged coaxially with the spindle shaft, in which case by the adjusting device at least the rotor together with the spindle shaft is axially displaceable with respect to the spindle housing in the direction of the tool axis of rotation, which, in particular, gives rise to a very compact construction.

However, in the case of very strong curvatures or larger changes in curvature over the circumference of the processed optically active surfaces, which require greater axial strokes at the tool, the use of this device finds its limits. Since the spindle shaft and rotor—which have a not inconsiderable mass—have to be moved in company with the respective axial stroke, rapid axial compensating movements, which might be required, of the tool are not possible.

What is needed is a polishing device having a simple and economic construction for fine processing of optically active surfaces at, in particular, spectacle lenses What is further needed is a polishing device by which a polishing tool can be rotationally driven as well as axially displaced—in which case the tool shall also be capable of executing rapid axial compensating movements—and which nevertheless is very compact, so that it can be used in, for example, "twin" polishing machines of very narrow construction such as, for example, the polishing machine described in the introduction.

SUMMARY OF THE INVENTION

According to one aspect of the invention, a device for fine processing of optically active surfaces at, in particular, spectacle lenses, has (i) a spindle shaft, which has a tool mounting section and which is mounted in a spindle housing to be rotatable about a tool axis of rotation, and (ii) an electric rotary drive, which has a rotor and a stator and by which the spindle shaft operatively connected with the rotor is rotatably drivable about the tool axis of rotation, while the tool mounting section is axially displaceable in the direction of the tool axis of rotation, the rotor and the stator of the electric rotary drive and the spindle shaft are arranged coaxially in the spindle housing, which in turn is guided in a guide tube to be capable of defined axial displacement in the direction of the tool axis of rotation (linear setting axis Z), wherein the spindle shaft is constructed as a hollow shaft by way of which the tool mounting section, which is constructed for mounting a diaphragm chuck tool, can be acted on by a fluid.

Due to the fact that in accordance with the invention the rotor and the stator of the electric rotary drive are arranged in common with the spindle shaft on one and the same axis, the device is advantageously of compact construction. In addition, the spindle shaft can be directly rotationally driven without requiring any transmission elements subject to play or liable to slip, such as gearwheels, cogged belts or the like, which overall reduces the outlay on hardware, significantly reduces the installation space requirement for this drive and, in addition, avoids losses in efficiency, due to transmission, as well as wear.

With respect to the axial adjustment possibility of the tool, there is provided in accordance with the invention two mechanisms of adjustment. First, the spindle housing—and thus the tool mounting section provided at the spindle shaft—is overall guided in the guide tube to be axially displaceable in the direction of the tool axis of rotation so that a diaphragm chuck tool held in the tool mounting section can be moved—although slowly—over relatively large axial paths and can be positioned with respect to the workpiece to be processed. Second, the tool mounting section is constructed for mounting a diaphragm chuck tool such as is known from, for example, the afore-mentioned specifications EP-A-1 473 116, EP-A-1 698 432 and EP-A-2 014 412, which can be there acted on by way of the hollow spindle shaft with a fluid or pressure medium so that, for example, a polishing plate held at the diaphragm chuck tool is capable of executing rapid or sensitive axial compensating movements corresponding with the respective processing requirements when, for example, workpieces with very pronounced curvatures or greater changes in curvature over the circumference are processed. In this connection it is to be noted that, for example, for use of the device according to the invention in a polishing machine for spectacle lenses the axial movement of the polishing tool should have a motion which is as easy as possible. This characteristic is important particularly for polishing spectacle lenses with toroidal, atoroidal or progressive surfaces with substantial departure from rotational symmetry, so that the polishing tool always bears fully or flatly and with a sensitively settable polishing force (or pressing force) against the spectacle lens. If, in particular, the polishing tool during its high-speed rotational movement were to lose surface contact with the workpiece surface even only temporarily, scratching of the polished spectacle lens surface could occur due to the coarser grains and agglomerates present in the polishing medium.

Moreover, the coaxial arrangement of axial guide for the rather lengthy axial tool movements (spindle housing in the guide tube) and pressure medium supply for the rather short axial tool compensating movements (hollow spindle shaft in the spindle housing) similarly give rise to a very compact construction of the device.

As a result, the device according to the invention is particularly suitable for use in, for example, the "twin" polishing machine described in the introduction, so that through use of other polishing methods with rotationally driven polishing tools the processing times can be significantly shortened (i.e., for example, divisor 2) without excessively increasing the low level of complexity of this polishing machine or unduly increasing the requirement thereof for installation or set-up space.

In principle, the spindle housing can of be made from one piece in the region of the mounting of spindle shaft and rotary drive. However, with respect to simple production and assembly it is preferred if the spindle housing comprises a motor housing, in which the rotor and the stator of the rotary drive are arranged, and a shaft housing, which is flange-mounted thereon and in which the spindle shaft is rotatably mounted.

In an advantageous embodiment of the device according to the invention the motor housing can moreover be closed by a cover having a passage bore in which a rotary leadthrough for the fluid is fastened, the leadthrough being disposed in fluid connection with the hollow spindle shaft. In this regard, various measures are conceivable for fastening the rotary leadthrough, for example a screw connection. However, the rotary leadthrough is preferably frictionally fastened in the passage bore of the cover by a resilient cable leadthrough bush, such as are inexpensively available in the marketplace.

In order to prevent, in simple manner, the guidance of the spindle housing in the guide tube being impaired or damaged by liquid polishing medium or the like a bellows surrounding the spindle housing can be arranged between the end of the guide tube remote from the rotary drive and the end of the spindle housing remote from the rotary drive. Equally, a centrifuging disc for a liquid fine-processing medium can be mounted at the end of the spindle shaft remote from the rotary drive so as to protect, in simple manner, the rotary seal (for example a pairing of labyrinth seal and radial sealing ring) between spindle housing and spindle shaft.

Various measures are similarly conceivable for the axial guidance of the spindle housing in the guide tube, for example spherical bushes or air-bearing bushes. However, since a particularly easy motion is not (no longer) required here, because the rapid tool (compensating) movements take place in the diaphragm chuck tool itself, it is preferred with regard to a long service life and costs if the tool housing is axially guided in the guide shoe by a slide ring.

Moreover, it is particularly advantageous to employ the afore-described device in double configuration in a polishing machine for simultaneous polishing of two spectacle lenses. The polishing machine includes (i) a machine housing bounding a work space, (ii) two workpiece spindles, which project into the work space and by way of which two spectacle lenses to be polished are drivable by a common rotary drive to rotate about substantially mutually parallel workpiece axes of rotation, (iii) a first linear drive unit, by which a first tool carriage is movable along a linear axis extending substantially perpendicularly to the workpiece axes of rotation, (iv) a pivot drive unit, which is arranged on the first tool carriage and by which a pivot yoke is pivotable about a pivot setting axis extending substantially perpendicularly to the workpiece axes of rotation and substantially perpendicularly to the linear axis and (v) a second linear drive unit, which is arranged on the pivot yoke and by which at least one second tool carriage is movable along a linear setting axis extending substantially perpendicularly to the pivot setting axis. The two devices protrude into the work space by their tool mounting sections each associated with a respective one of the tool spindles and are flange-mounted by the respective spindle housing thereof on the at least one second tool carriage. The respective guide tube is mounted on the pivot yoke so that the tool axis of rotation of each device forms together with the workpiece axis of rotation of the associated workpiece spindle a plane in which the respective tool axis of rotation is axially displaceable and tiltable with respect to the workpiece axis of rotation of the associated workpiece spindle.

A "twin" polishing machine constructed and equipped in such a manner is distinguished not only by the fact that it is of very compact construction—to that extent also easily manually loaded—and in very economic manner uses a number of common drives, but particularly also by the fact that the movement possibilities provided by the devices according to the invention, namely the active rotational movement possibility of the polishing tools mountable thereon, enable by comparison with the prior art outlined in the introduction the performance of other polishing methods which are, in particular, more rapid and more efficient in terms of time.

In a particularly simple and economic embodiment of the polishing machine merely one second tool carriage for common axial movement of the two spindle housings by the second linear drive unit can be provided. As a consequence of the given capability of axial movement in the respective diaphragm chuck tool it is nevertheless possible to adapt each tool individually to the respective processed surface.

Finally, it is advantageous particularly with respect to, again, a simple and economic embodiment of the polishing machine if not only the pivot drive unit, but also the second linear drive unit are proprietary linear modules each with a stroke rod which can be moved in and out by way of a spindle drive driven by a direct-current motor.

BRIEF DESCRIPTION OF THE DRAWINGS

The invention is explained in more detail in the following by way of a preferred embodiment with reference to the accompanying, partly simplified or schematic drawings, in which.

DETAILED DESCRIPTION OF THE EMBODIMENT

Figure 1:
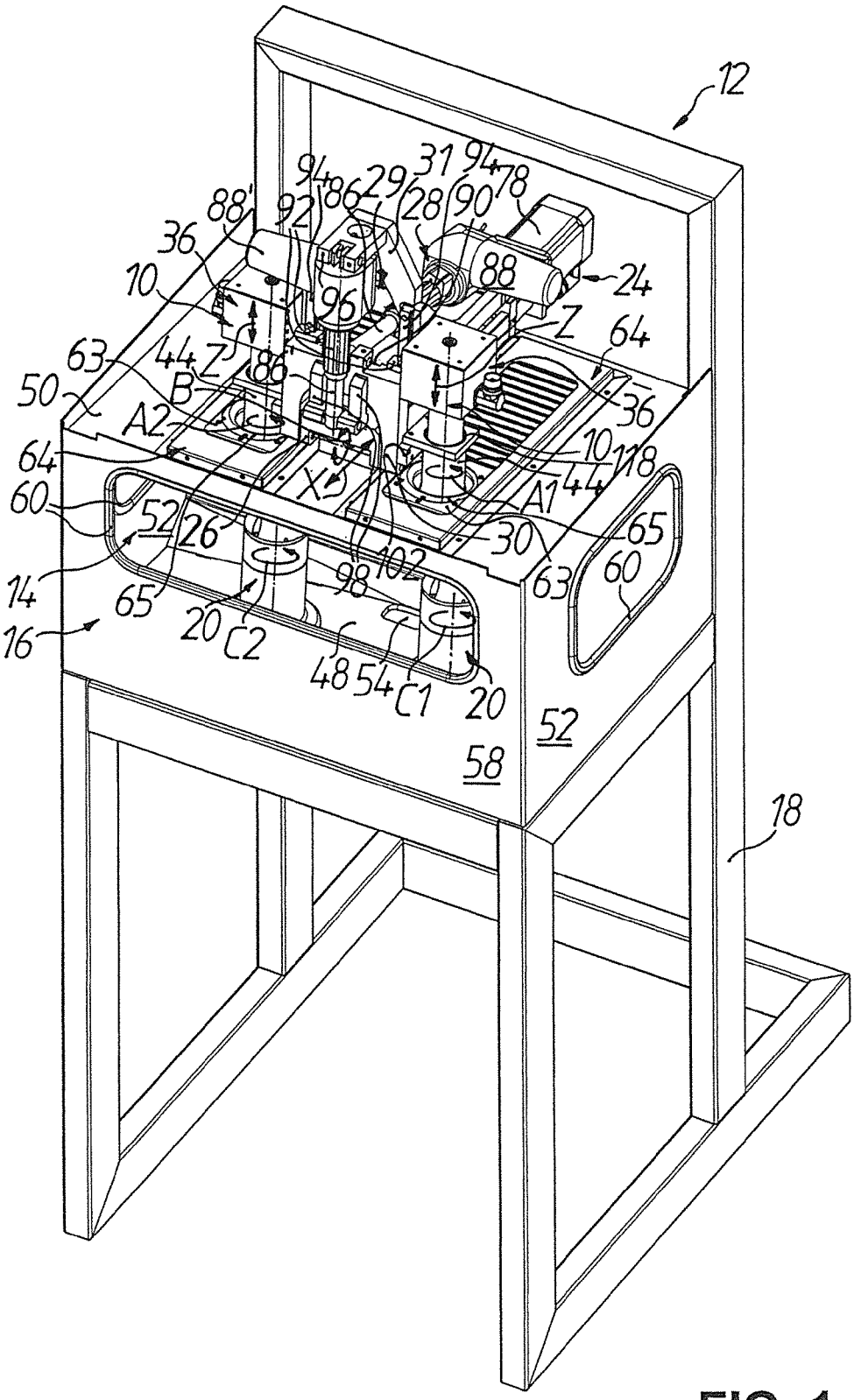
FIG. 1 shows a perspective view of a polishing machine for spectacle lenses from obliquely above/front right with two parallelly arranged devices according to the invention for fine processing of the optically active surfaces of spectacle lenses, wherein in order to free a view of the significant components or subassemblies of the machine and for simplification of the illustration, in particular, the control unit and control, parts of the casing, door mechanisms and panes, deposits for workpieces and tools, supply devices (including lines, hoses and pipes) for current, compressed air and polishing medium, the polishing medium return as well as measuring, maintenance and safety devices have been omitted.

A polishing machine in "twin" mode of construction, i.e. for simultaneous polishing of two spectacle lenses L, as a preferred case of use or use location of a device 10, which is still to be described in detail in the following, for fine processing of optically active surfaces of workpieces such as, for example, spectacle lenses L (cf. FIG. 5) is denoted by 12 in FIGS. 1 to 5.

The polishing machine 12 comprises generally (i) a machine housing 16, which bounds a work space 14 and which is mounted on a machine frame 18, (ii) two workpiece spindles 20, which project into the work space 14 and by way of which two spectacle lenses L to be polished can be driven by a common rotary drive 22 (see FIGS. 3 to 5) to rotate about substantially mutually parallel workpiece axes of rotation C1, C2 (C in FIG. 9), (iii) a first linear drive unit 24, by which a first tool carriage 26 can be moved along a linear axis X extending substantially perpendicularly to the workpiece axes of rotation C1, C2, (iv) a pivot drive unit 28, which is arranged on the first tool carriage 26 and by which a pivot yoke 30 can be pivoted about a pivot setting axis B extending substantially perpendicularly to the workpiece axes of rotation C1, C2 and substantially perpendicularly to the linear axis X, (v) a second linear drive unit 29, which is arranged on the pivot yoke 30 and by which a second tool carriage 31 can be moved along a further linear setting axis Z extending substantially perpendicularly to the pivot setting axis B and finally (vi) two of the devices 10 already mentioned above.

As will be explained in more detail in the following particularly with reference to FIGS. 6 to 9, each of the devices 10 comprises in general (a) a spindle shaft 32, which has a tool mounting section 34 and which is mounted in a spindle housing 36 to be rotatable about a tool axis of rotation A1, A2 (A from FIG. 6) and (b) an electric rotary drive 38 (see FIG. 8), which comprises a rotor 40 and a stator 42 and by which the spindle shaft 32 operatively connected with the rotor 40 can be driven to rotate about the tool axis of rotation A1, A2 (A). Significant features of the device 10 in that regard include that the rotor 40 and the stator 42 of the electric rotary drive 38 as well as the spindle shaft 32 can be coaxially arranged in space-saving manner in the spindle housing 36, which in turn is guided in a guide tube 44 to be capable of defined axial displacement in the direction of the tool axis of rotation A1, A2 (A) (linear setting axis Z), wherein the spindle shaft 32 is constructed as a hollow shaft, by way of which the tool mounting section 34 constructed for mounting of a diaphragm chuck tool 46 can be acted on by a fluid—as will be described in the following similarly in more detail—so that, for example, a polishing plate 47 mounted on the diaphragm chuck tool 46 is capable of rapidly executing comparatively small axial compensating movements (linear movement Z' as shown in FIGS. 5-9).

According to FIGS. 1 to 5, the devices 10 are now flange-mounted by their respective spindle housing 36 on the second tool carriage 31 of the polishing machine 12 and fastened by the respective guide tube 44 to the pivot yoke 30 of the polishing machine 12 in such a manner that they protrude into the work space 14 by their tool mounting sections 34 respectively associated with the workpiece spindles 20. In that case, the tool axis of rotation A1, A2 of each device 10 forms with the workpiece axis of rotation C1, C2 of the associated workpiece spindle 20 a notional plane (perpendicularly to the drawing plane of FIG. 4 and parallel to the drawing plane of FIG. 5), in which the respective tool axis of rotation A1, A2 is axially displaceable (linear axis X, linear setting axis Z) and tiltable (pivot setting axis B) with respect to the workpiece axis of rotation C1, C2 of the associated workpiece spindle 20. The tool mounting section 34 of the spindle shaft 32 cannot be seen in FIG. 5, because the diaphragm chuck tool 46 is mounted on the tool mounting section 34, as FIGS. 6 to 9 also illustrate.

Figure 2:
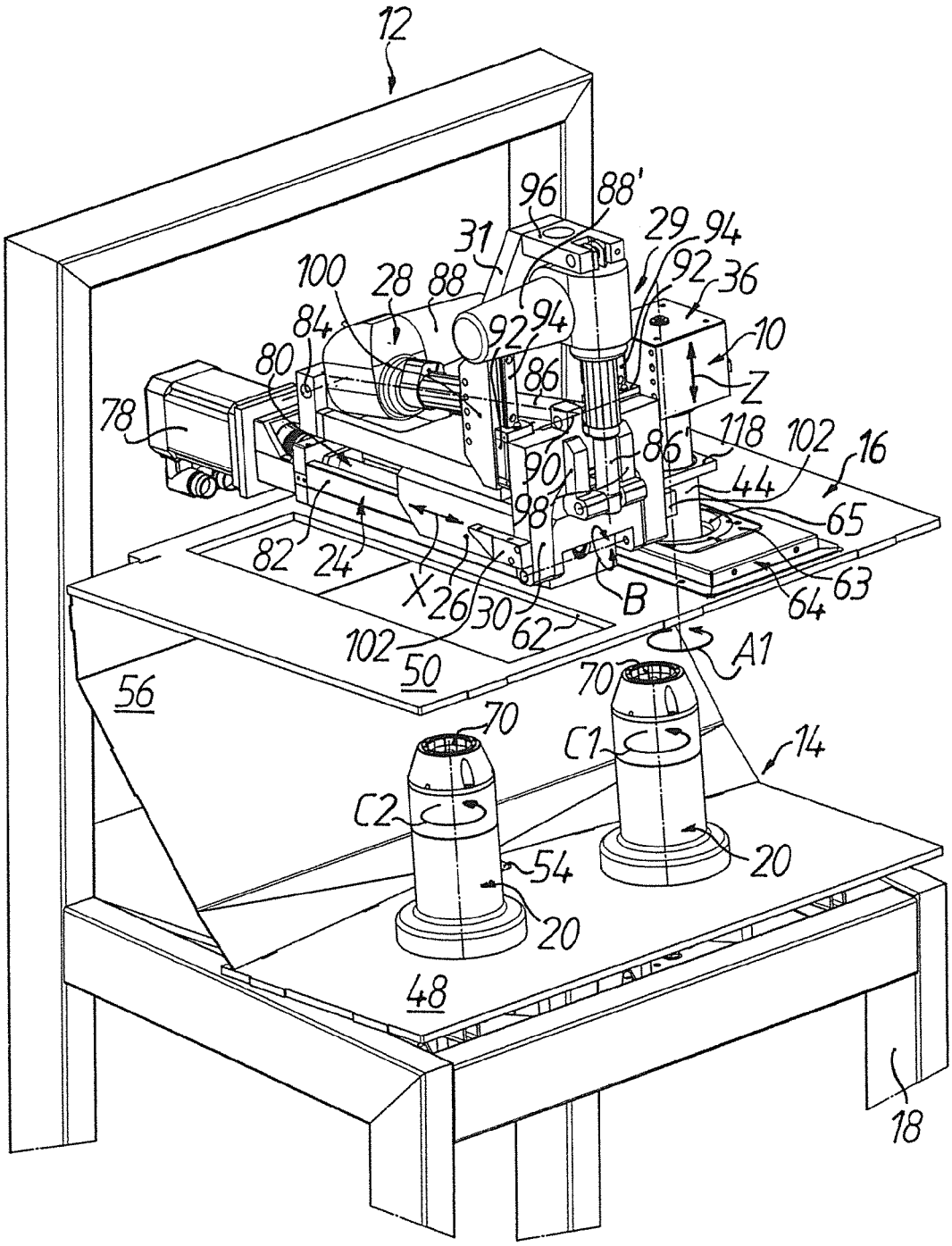
FIG. 2 shows, in an enlarged scale by comparison with FIG. 1, a perspective view, which is broken away at the machine frame, of the polishing machine according to FIG. 1 from obliquely above/front left, in which case on the one hand the device according to the invention at the left in FIG. 1 and an associated flexible work space cover have been omitted so as to illustrate the connecting situation for the device according to the invention on the left in FIG. 1, and on the other hand the side walls and the front wall of the sheet-metal housing bounding the work space so as to free a view of two parallel arranged workpiece spindles, of which each workpiece spindle is associated with a respective one of the devices according to the invention.

The machine housing 16 mounted—according to, in particular, FIG. 2—at an inclination on the machine frame 18 is constructed as a welded sheet-metal housing with a base plate 48, a top plate 50, two side walls 52, a back wall 56, which is inclined towards an outflow 54 provided in the base plate 48, and a front wall 58, which in total bound the work space 14. Whereas the side walls 52 and the front wall 58 are provided with windows 60, round cut-outs (not shown in more detail) for passage of the workpiece spindles 20 and a drive shaft 61 of the rotary drive 22 are provided in the base plate 48 and elongate cut-outs 62 (see FIGS. 2 to 4) for passage of the devices 10 into the work space 14 are provided in the top plate 50. The elongate cut-outs 62 also enable axial forward and backward movement of the devices 10 in the direction of the linear axis X, i.e. in the direction of the front wall 58, and away therefrom, wherein for sealing relative to the work space 14 in the illustrated embodiment a respective bellows cover 64, which comprises a slide plate 63, is provided as flexible work space cover. In this regard, the guide tube 44 of the respective device 10 passes through a hole in the respective slide plate 63, wherein a roll bellows 65 ensures a tiltingly movable sealing between guide tube 44 and slide plate 63.

Figure 4:
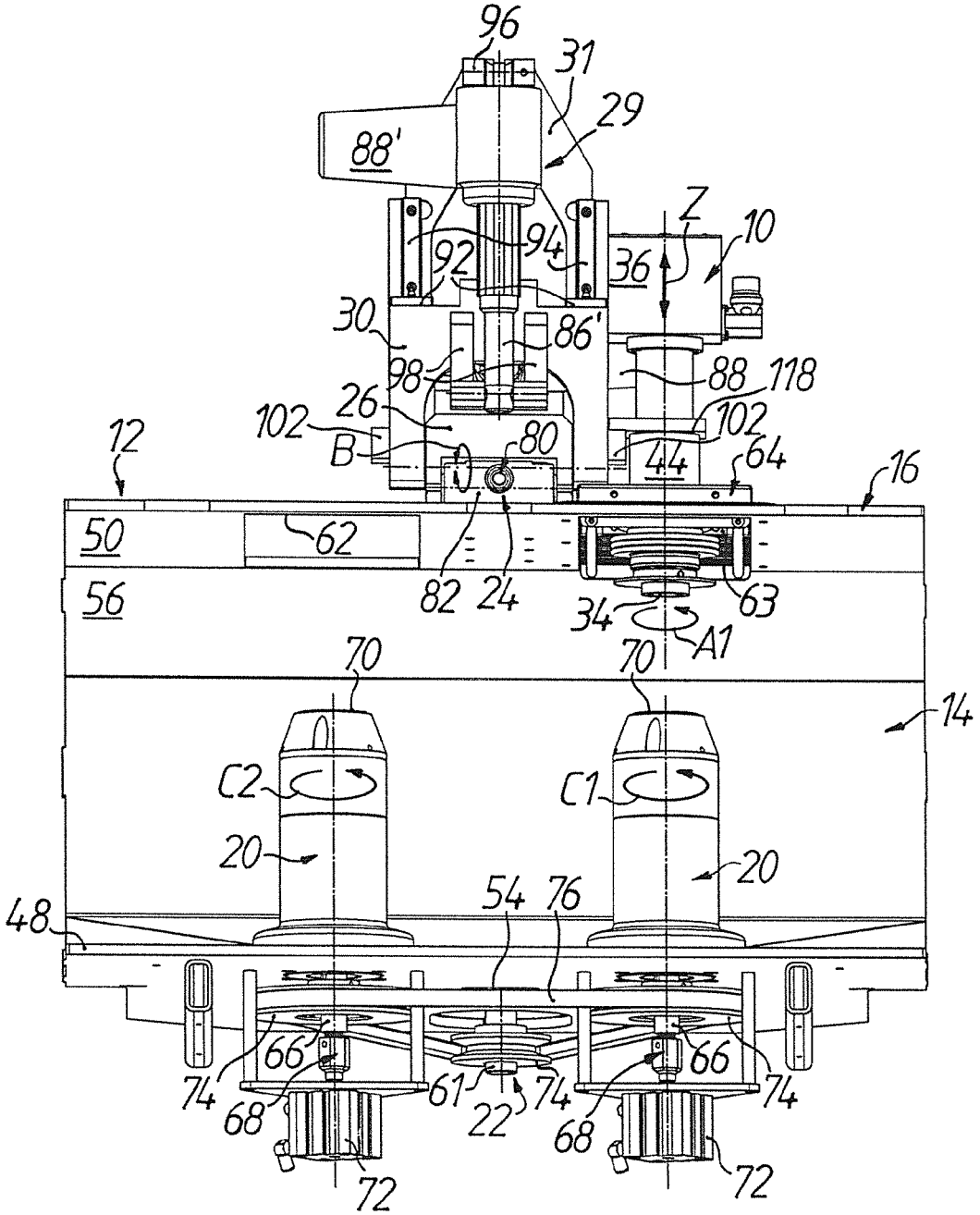
FIG. 4 shows a front view of the polishing machine according to FIG. 1 in the scale of FIG. 3 and with the simplifications of FIG. 3.
Figure 5:
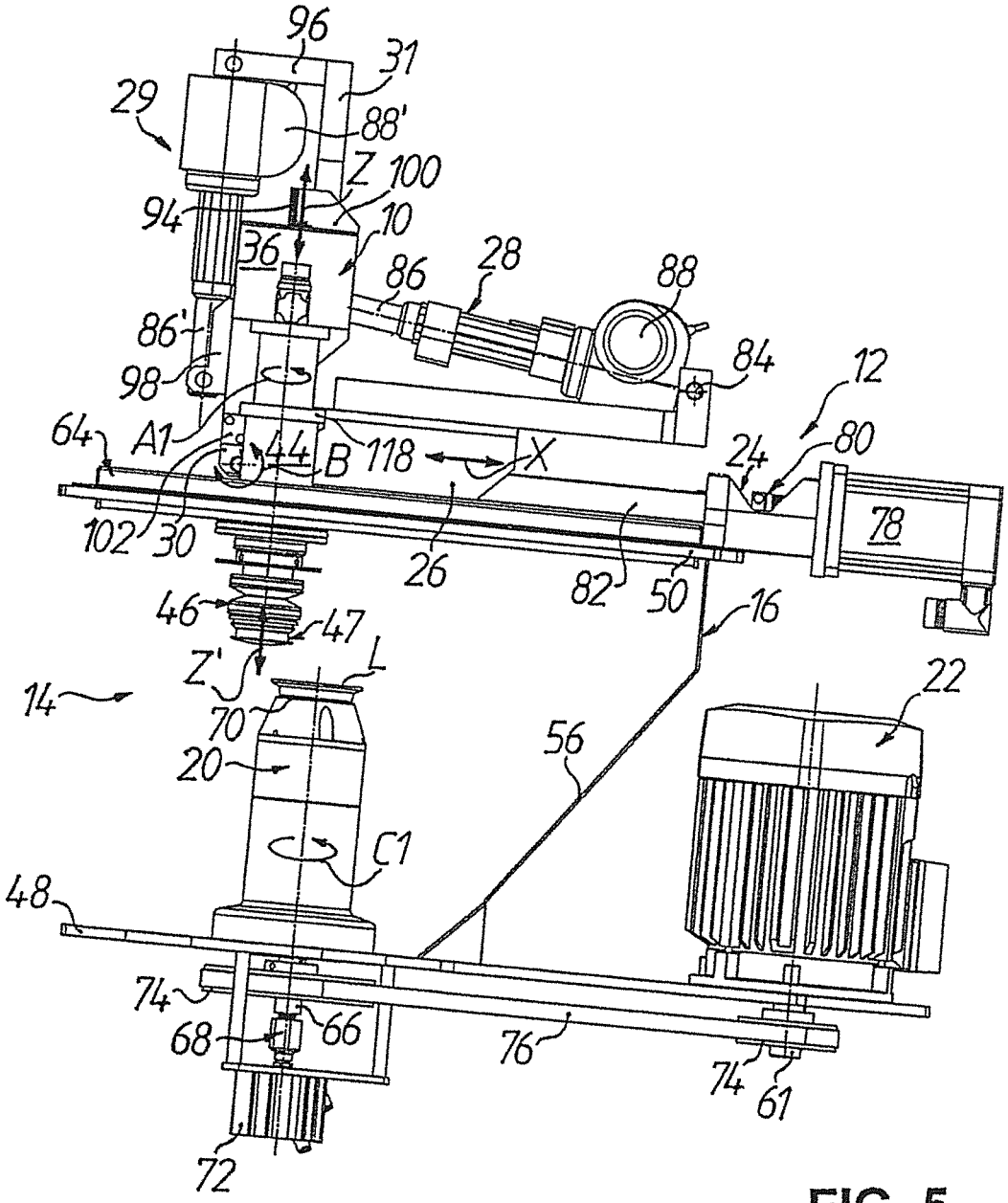
FIG. 5 shows a side view of the polishing machine according to FIG. 1 from the right in FIG. 4, again in the scale of FIG. 3 and with the simplifications of FIG. 3, wherein by contrast with FIG. 4 a diaphragm chuck tool with polishing plate is mounted on the device according to the invention.
Figure 9:
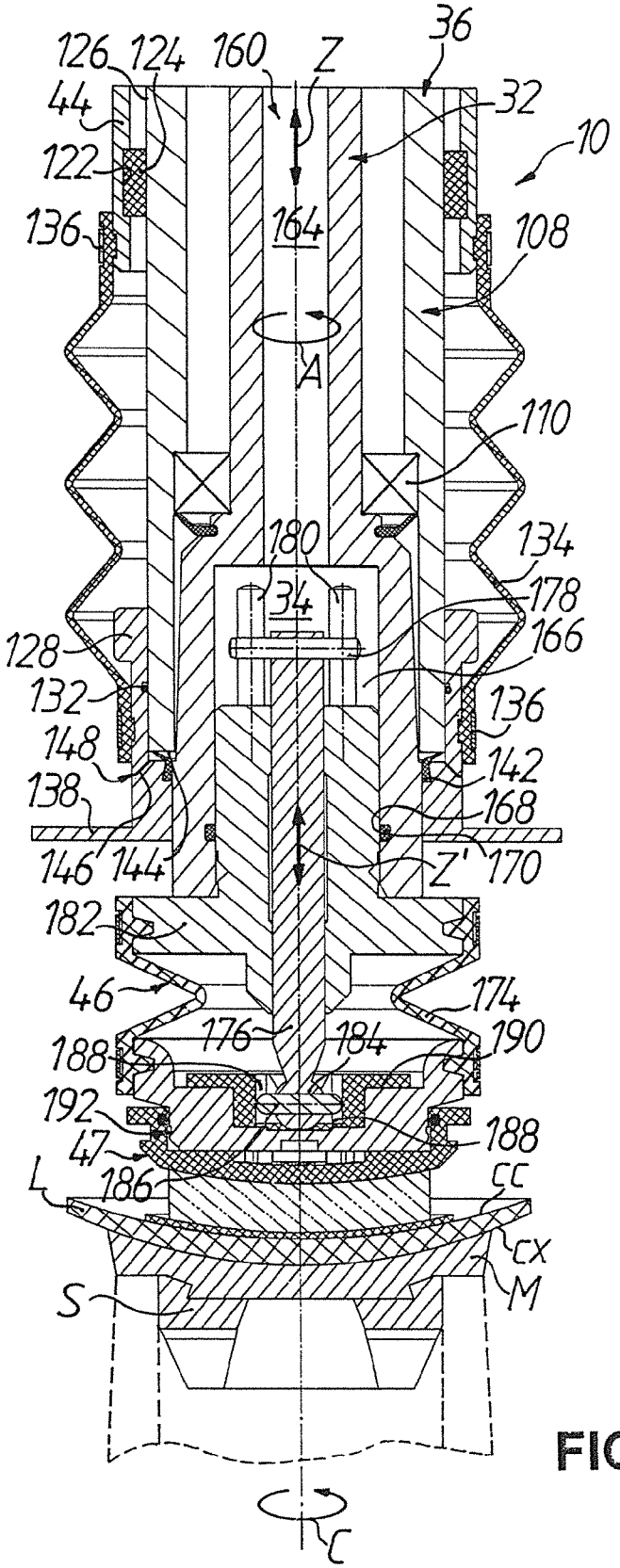
FIG. 9 shows a broken-away sectional view of the device according to the invention from FIG. 6 in correspondence with the section line IX-IX in FIG. 8, wherein, however, the device is illustrated in a moved-out state in which the diaphragm chuck tool mounted on the device and provided with a polishing plate is disposed in processing engagement with a spectacle lens, which is mounted by a block piece on a workpiece spindle indicated by dashed lines.

As can be readily seen in, in particular, FIGS. 4 and 5, the workpiece spindles 20 in the work space 14 are flange-mounted from above on the base plate 48 and each pass through this by a drive shaft 66 and an actuating mechanism 68 for a collet chuck 70, by which a spectacle lens L blocked on a block piece S can be clamped axially firmly to the respective workpiece spindle 20 to be capable of rotational entertainment (cf. FIGS. 5 and 9). Pneumatic cylinders, which are fastened below the base plate 48, of the actuating mechanism 68 are denoted by 72, by which mechanisms the collet chucks 70 can be opened and closed in a manner known per se. Behind the rear wall 56, i.e. outside the work space 14, the rotary drive 22—in the illustrated embodiment a speed-controlled asynchronous three-phase motor—is similarly flange-mounted from above on the base plate 48. In addition, belt pulleys 74 are fastened below the base plate 48 to the drive shafts 61, 66 of rotary drive 22 and workpiece spindles 20 and are operatively connected by a V-belt 76, so that the rotary drive 22 is capable of rotationally driving the two workpiece spindles 20 at the same time at a predetermined rotational speed (workpiece axes of rotation C1, C2 or C).

Figure 3:
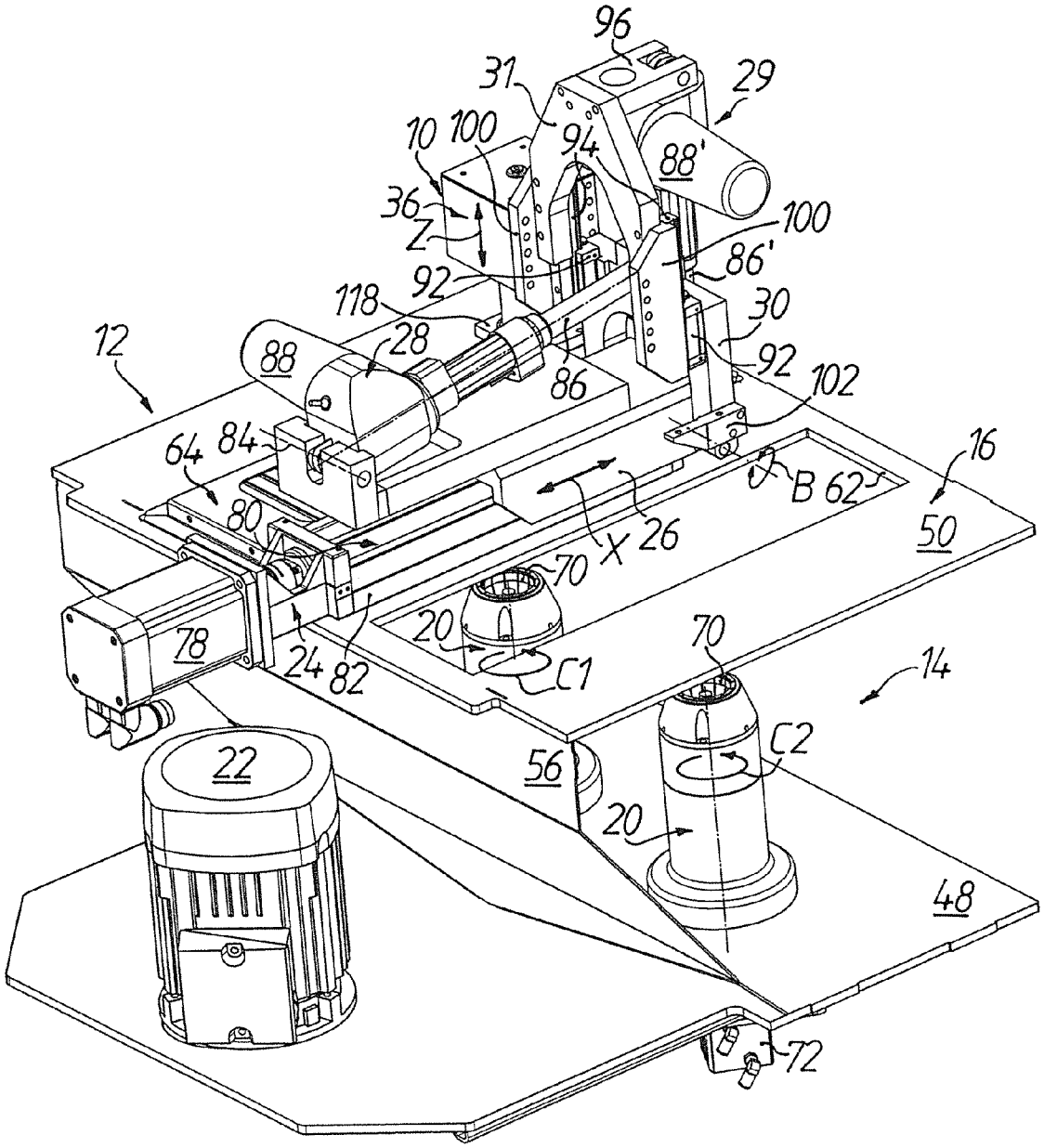
FIG. 3 shows a perspective view, which is further enlarged in scale by comparison with FIG. 2, of the polishing machine according to FIG. 1 from obliquely above/right rear, wherein by comparison with the illustration in FIG. 2 the machine frame has in addition been omitted.

As can be best seen in FIGS. 2 to 4, the first linear drive unit 24 in the illustrated embodiment comprises a ball screw 80, which is driven by a servomotor 78 via a clutch and received in a guide box 82, which is fastened from above on the top plate 50 and on which the first tool carriage 26 is guided. This substantially horizontally extending linear axis X is subject to CNC positional regulation; however, for simplification of the illustration the associated travel measuring system is not shown.

According to FIGS. 1 to 4 the substantially U-shaped pivot yoke 30 is pivotably connected by its limbs at the end, which is in the front in FIGS. 1 and 2, of the first tool carriage 26 so that it can pivot about the pivot setting axis B. The pivot drive unit 28 is pivotably connected at the end, which is at the back in FIG. 2 or on the right in FIG. 5, of the first tool carriage 26 so that it can pivot about an axis 84. The pivot drive unit 28 in the illustrated embodiment is a proprietary linear module such as referred to, for example, by the designation "stroke cylinder CARE 33" of the company SKF. These linear modules, which are used in large numbers as, for example, automatic window openers or for adjusting hospital beds, have a stroke rod 86 which can be moved in or out by way of a spindle drive (not shown in more detail) driven by a direct-current motor 88. In this regard, self-locking of the spindle drive is of such a level that when the direct-current motor 88 is switched off the stroke rod 86 itself remains in the position, into which it has been driven, under greater axial loads without needing a brake or the like for that purpose. The stroke rod 86 of the pivot drive unit 28 is now pivoted by its end, which is remote from the direct-current motor 88, in a centre region, which is at the top in FIGS. 1 to 4, of the U-shaped pivot yoke 30 so that the stroke rod 86 can pivot relative to the pivot yoke 30 about a further axis 90 (cf. FIGS. 1 and 2). To that extent it is evident that with the articulation linkage constructed as described above a defined axial movement out or movement in of the stroke rod 86 has the consequence that the pivot yoke 30 is pivoted in defined manner about the pivot setting axis B.

As FIGS. 1 to 3, in particular, further show linear guide carriages 92 are mounted on both sides of the pivot yoke 30 at the end thereof facing the pivot drive unit 28 and co-operate with respectively associated linear guide rails 94, which are in turn mounted on both sides of the substantially V-shaped second tool carriage 31 at the end remote from the pivot drive unit 28. A holder 96 for the second linear drive unit 29 is fastened to the end, which is upper in FIGS. 1 to 5, of the second tool carriage 31. The second linear drive unit 29 in the illustrated embodiment is—as in the case of the pivot drive unit 28—similarly a proprietary linear module, with a stroke rod 86' which can be moved in or out by way of a spindle drive (not illustrated in more detail) driven by a direct-current motor 88'. The stroke rod 86' of the second linear drive unit 29 is now pivotably connected by its end, which is remote from the direct-current motor 88', with two counter-holders 98 which in turn are fastened to a centre region of the U-shaped pivot yoke 30. To that extent it is evident that an axial movement in or movement out of the stroke rod 86' has the consequence that the second tool carriage 31, guided at the pivot yoke 30, is subject to a defined axially upward or downward displacement with respect to the pivot yoke 30 and, in particular, along the linear setting axis Z.

According to, in particular, FIGS. 2 and 3 the second tool carriage 31 finally has on each of the two sides a respective side cheek 100 at which the spindle housing 36 of the respective device 10 is flange-mounted. In addition, a respective fastening bracket 102, at which the guide tube 44 of the respective device 10 is mounted as will be described in more detail in the following, is mounted on the pivot yoke 30 on either side of the pivot yoke 30 near the pivot setting axis B.

Insofar as the possibilities of movement of the diaphragm chuck tool 46 mounted on the device 10 are concerned, it is to be established at this point that the electric rotary drive 38 of the device 10—in the illustrated embodiment a synchronous three-phase motor—is subject to rotational speed control (tool axes of rotation A1, A2 or A). The linear movement, which can be produced by the second linear drive unit 29 via the second tool carriage 31, of the diaphragm chuck tool 46, which is mounted on the device 10, in the direction Z is, thereagainst, a setting movement. This movement possibility predominantly serves the purpose of (1) positioning the diaphragm chuck tool 46 opposite the spectacle lens L before the actual polishing process (linear setting axis Z), whereupon the polishing plate 47 mounted on the diaphragm chuck tool 46 is brought by pressure medium loading of the diaphragm chuck tool 46 via the hollow spindle shaft 32 into contact with the spectacle lens L (linear movements Z'1, Z'2 in FIG. 5 or Z' from FIG. 6) and is pressed during the polishing process by a predetermined force in the direction of the spectacle lens L in order to generate a polishing pressure, and (2) lifting the diaphragm chuck tool 46 away from the spectacle lens L again after the polishing process.

Accordingly, the afore-described polishing machine 12 enables, for example, the following procedure, which shall be described for only one spectacle lens L, because the second spectacle lens L of the respective "RX job" is subject to polishing processing in analogous manner and at the same time. After equipping the polishing machine 12 with the diaphragm chuck tools 46 and the polishing plates 47 as well as the spectacle lenses L to be processed, the angle of incidence of the tool axes of rotation A1, A2 or A with respect to the workpiece axes of rotation C1, C2 or C is initially set to a predetermined angular value by the pivot drive unit 28 in dependence on the geometry to be processed at the spectacle lens L (pivot setting axis B). This angle of incidence is not changed during the actual polishing processing. The diaphragm chuck tool 46 is then moved by the first linear drive unit 24 into a position in which it is opposite the spectacle lens L (linear axis X). The diaphragm chuck tool 46 is thereafter axially displaced and positioned by the second linear drive unit 29 in the direction of the spectacle lens L (linear setting axis Z), whereupon the polishing plate 47 is brought into contact with the spectacle lens L by pressure medium loading of the diaphragm chuck tool 46 via the hollow spindle shaft 32 (linear movement Z'). The polishing medium feed is now switched on and the diaphragm chuck tool 46 with the polishing plate 47 as well as the spectacle lens L are set into rotation by the electric rotary drive 38 or the rotary drive 22 (tool axes of rotation A1, A2 or A; workpiece axes of rotation C1, C2 or C). For preference, synchronous motion of tool and workpiece takes place here; however, it is also possible to drive tool and workpiece in opposite sense and/or let them rotate at different rotational speeds. The diaphragm chuck tool 46 is now reciprocatingly moved by the first linear drive unit 24 with relative small strokes over the spectacle lens L (linear axis X) so that the polishing plate 47 is guided over different area regions of the spectacle lens L. In this regard, the polishing plate 47 also moves, following the (non-circular) geometry at the polished spectacle lens L, slightly up and down (linear movement Z'). Finally, after switching-off of the polishing medium feed and stopping of the rotational movements of tool and workpiece (tool axes of rotation A1, A2 or A; workpiece axes of rotation C1, C2 or C) as well as pressure medium relief of the diaphragm chuck tool 46 via the hollow spindle shaft 32 the diaphragm chuck tool 46 is lifted away from the spectacle lens L by the second linear drive unit 29 (linear setting axis Z). Lastly, the diaphragm chuck tool 46 is moved by the first linear drive unit 24 into a position (linear axis X) which allows removal of the spectacle lens L from the polishing machine 12 or change of the diaphragm chuck tool 46 and/or the polishing plate 47.

Although the movements in B and Z above were described as pure setting movements serving the purpose of positioning the respective diaphragm chuck tool 46 in terms of angle or in axial direction relative to the associated workpiece spindle 20 in advance of the actual polishing processing, the drive units provided for that purpose (pivot drive unit 28, second linear drive unit 29) can obviously move, for example continuously, the respective diaphragm chuck tool 46 even during the actual polishing processing if this is required or desired.

The construction and functioning of the device 10 are described in more detail in the following with reference to FIGS. 6 to 9.

Figure 7:
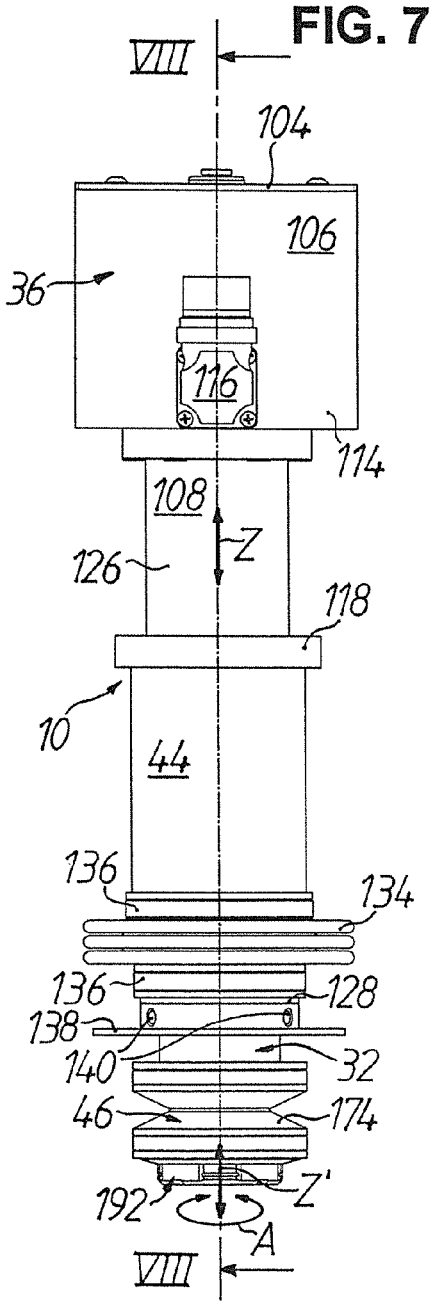
FIG. 7 shows a front view of the device according to the invention from FIG. 6.
Figure 8:
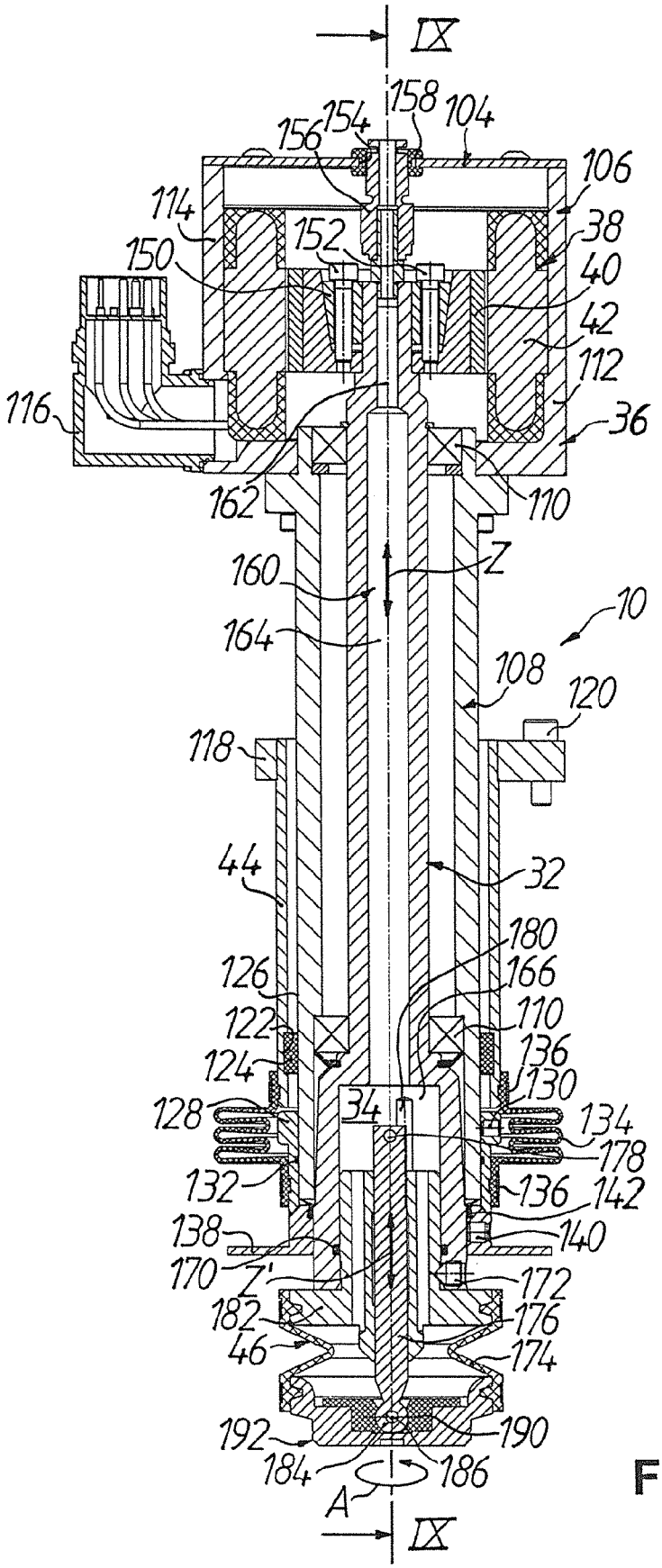
FIG. 8 shows a sectional view, which is enlarged in scale by comparison with FIGS. 6 and 7, of the device according to the invention from FIG. 6 in correspondence with the section line VIII-VIII in FIG. 7.

According to, in particular, FIGS. 8 and 9 the spindle housing 36 is of multi-part construction, with a substantially cube-shaped motor housing 106, which is closed by a cover 104 at the top in FIG. 8 and in which the rotor 40 and the stator 42 of the electric rotary drive 38 are arranged, and a sleeve-shaped shaft housing 108, which is flange-mounted thereon and in which the spindle shaft 32 is rotatably mounted by way of two bearings 110. The motor housing 106 is flange-mounted, by the side wall 112 at the back in FIGS. 6 and 7 and on the right in FIG. 8, at the side cheek 100 of the second tool carriage 31 with the assistance of screws (not shown), as can be seen in FIGS. 2 and 3. A plug connection 116 for electrical power supply of the rotary drive 38 and associated signal/sensor cable is provided on the side wall 114, which is at the front in FIGS. 6 and 7 and on the left in FIG. 8, of the motor housing 106.

Figure 6:
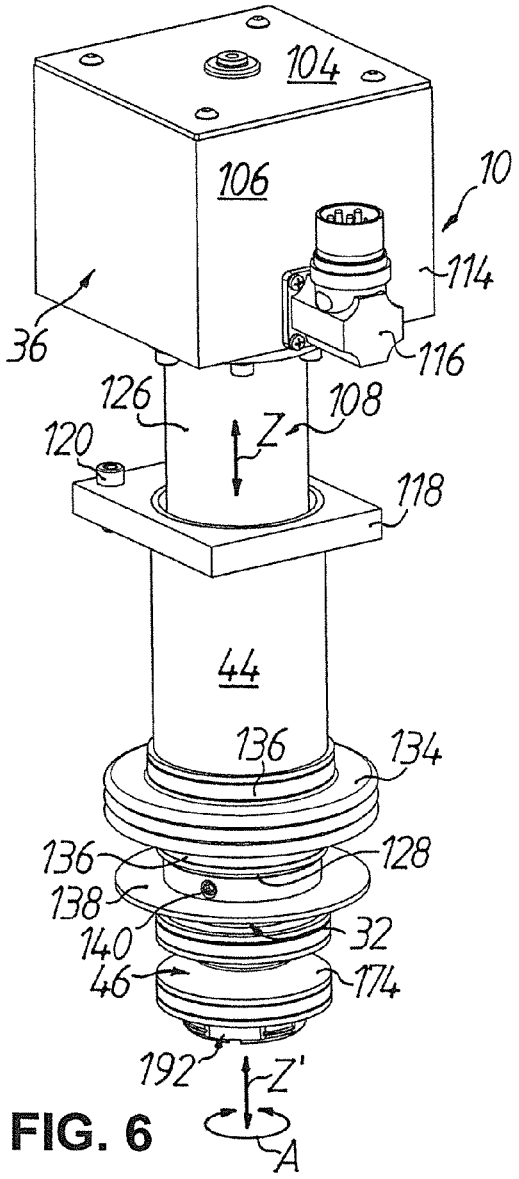
FIG. 6 shows a perspective view, which is enlarged in scale by comparison with FIGS. 1 to 5, of one of the devices according to the invention from the polishing machine according to FIG. 1, with diaphragm chuck tool mounted thereon without polishing plate.

The hollow-cylindrical guide tube 44 can be seen in the lower part of FIGS. 6 to 8, which tube is connected at its end, which is upper in the figures, with a fastening plate 118 having a passage bore, for example by way of an adhesive and/or clamp connection, which in turn is screw-connected by screws 120, which are shown in FIGS. 6 and 8, from above with the associated fastening bracket 102 at the pivot yoke 30 of the polishing machine 12 in order to fasten the guide tube 44 to the pivot yoke 30, as illustrated in FIGS. 1, 2, 4 and 5.

Inserted into a radial groove 122, which is provided at the inner circumferential side, of the guide tube 44 near the end of the guide tube 44 which is lower in FIGS. 8 and 9 is a slide ring or guide ring 124 of plastics material which co-operates with a cylindrical outer circumferential surface 126 of the shaft housing 108 in order to axially guide the spindle housing 36 in the guide tube 44 substantially free of radial play.

An annular part 128 is pushed onto the end, which is lower in FIGS. 8 and 9, of the shaft housing 108 extending through the guide tube 44, which annular part is clamped by set screws 130 (FIG. 8) to the outer circumferential surface 126 of the shaft housing 108, wherein an O-ring 132 seals between the outer circumferential surface 126 of the shaft housing 108 and the inner circumferential surface of the annular part 128. In addition, a bellows 134 which surrounds the shaft housing 108 of the spindle housing 36 is arranged between the end, which is remote from the rotary drive 38, i.e. lower in FIGS. 8 and 9, of the guide tube 44 and the end, which is remote from the rotary drive 38, i.e. lower in FIGS. 8 and 9, of the shaft housing 108. In that case, the bellows 134 is fastened at each of its axial ends by a clamping ring 136 or a clamping clip on the outer circumferential surface of the guide tube 44 or of the annular part 128.

Moreover, a centrifuging disc 138, which acts as a centrifugal seal, for the liquid polishing agent is mounted on the end, which is remote from the rotary drive 38, i.e. lower in FIGS. 8 and 9, of the spindle shaft 32 extending through the shaft housing 108 and, in particular, similarly by clamping by set screws 140 (FIGS. 6 to 8). In this regard, the centrifuging disc 138 holds at the inner circumferential side a radial sealing ring 142 which sealingly co-operates with an annular end surface 144 (FIG. 9) of the shaft housing 108 or the inner circumferential surface of the annular part 128 and in addition forms with an inclined end surface 146 of the annular part 128 a small gap 148 which can be similarly inferred from FIG. 9.

In the interior of the motor housing 106 the stator 42 of the electric rotary drive 38, the windings of which are indicated in FIG. 8, is cast together with the motor housing 106. The electric rotary drive 38, which has a large, steplessly controllable rotational speed range, is air-cooled and has for this purpose a fanwheel (not illustrated) in the upper region of the rotor 40. At its end, which is upper in FIG. 8 and which protrudes into the motor housing 106, the spindle shaft 32 carries the rotor 40, which is connected there in suitable manner with the spindle shaft 32 to be secure against relative rotation, for example by an annular clamping element 150 or another known shaft/hub connection. The associated clamping screws 152 in that case serve at the same time for fastening the fanwheel (not shown).

In FIG. 8 above the spindle shaft 32 the cover 104 of the motor housing 106 is provided with a central passage bore 154 in which a proprietary rotary leadthrough 156 (rotational plug screw connection) for the fluid or pressure medium for action on the diaphragm chuck tool 46 is fastened, which is disposed in fluid connection with the hollow spindle shaft 32. In that case the rotary leadthrough 156 is frictionally fixed in the passage bore 154 of the cover 104 by a resilient cable leadthrough bushing 158.

The spindle shaft 32 has a continuous stepped bore 160 with three cylindrical bore sections 162, 164, 166, which in FIG. 8 increase in diameter from the top to the bottom. The rotary leadthrough 156 is plugged into the upper bore section 162. The middle bore section 164, which extends in axial direction substantially between the bearings 110 of the spindle shaft 32, connects the upper bore section 162 with the lower bore section 166. Finally, the lower bore section 166 forms the tool mounting section 34 for the diaphragm chuck tool 46 and is provided with a radial groove 168 for reception of an O-ring 170, which ensures sealing between spindle shaft 32 and diaphragm chuck tool 46.

Finally, the diaphragm chuck tool 46 retained at the tool mounting section 34 of the spindle shaft 32 by a set screw 172 (FIG. 8) is illustrated by way of example in FIGS. 6 to 9. This can in principle correspond with the polishing tools, which are disclosed in the already mentioned specifications EP-A-1 473 116, EP-A-1 698 432 and EP-A-2 014 412, to which at this point express reference is made with respect to the construction and functioning of such diaphragm chuck tools 46.

However, in the present case of an actively driven spindle shaft 32 the rotational entrainment in the diaphragm chuck tool 46 is realized differently and, in particular, not by way of the bellows 174 of the diaphragm chuck tool 46, but by way of the guide element 176 axially displaceable in the diaphragm chuck tool 46. In this regard, the guide element 176 is supported at its end, which is upper in FIGS. 8 and 9, by way of a transverse pin 178 at two longitudinal pins 180 which are fastened at the base body 182 of the diaphragm chuck tool 46. Similarly, provided at its spherical head end 184, which is lower in FIGS. 8 and 9, is a transverse pin 186 which engages by associated cut-outs 188 (FIG. 9) in the spherical head bearing 190. Finally, the polishing plate 47 is exchangeably retained at the diaphragm chuck tool 46 by way of an interface 192. Such polishing plates 47 are evident from, for example, the specification DE-A-10 2007 026 841; the interface 192 substantially corresponds with the interface illustrated and described in DE-A-10 2009 036 981. To that extent, incorporation by reference hereby made at this point to the mentioned specifications.

If in the present documents there is reference generally to "fluid", there is to be understood by that gases such as, for example, compressed air, or liquids, such as, for example, oil, which can be used as a pressure medium.

There is disclosed a device for fine processing of optically active surfaces at, in particular, spectacle lenses, with a spindle shaft, which has a tool mounting section and which is mounted in a spindle housing to be rotatable about a tool axis of rotation, and an electric rotary drive, which comprises a rotor and a stator and by which the spindle shaft operatively connected with the rotor is drivable to rotate about the tool axis of rotation, whilst the tool mounting section is axially displaceable in the direction of the tool axis of rotation. A feature of this device is that the rotor and stator as well as the spindle shaft are arranged coaxially in the spindle housing, which in turn is guided in a guide tube to be capable of defined axial displacement in the direction of the tool axis of rotation, wherein the spindle shaft is constructed as a hollow shaft by way of which the tool mounting section, which is constructed for mounting of a diaphragm chuck tool, can be acted on by a fluid, which, in particular gives rise to a very compact construction and enables rapid axial compensating movements of the tool in the case of fine processing.

Variations and modifications are possible without departing from the scope and spirit of the present invention as defined by the appended claims.

The invention claimed is:

1. A device for fine processing of optically active surfaces of spectacle lenses comprising a spindle shaft, which has a tool mounting section and which is mounted in a spindle housing to be rotatable about a tool axis of rotation, and an electric rotary drive, which comprises a rotor and a stator and by which the spindle shaft operatively connected with the rotor is drivable to rotate about the tool axis of rotation, and the tool mounting section is axially displaceable in the direction of the tool axis of rotation, said device being characterized in that the rotor and the stator of the electric rotary drive and the spindle shaft are coaxially arranged in the spindle housing, which in turn is guided in a guide tube, said rotor, stator, spindle shaft and spindle housing are axially movable with a defined axial displacement in the direction along the tool axis of rotation relative to the guide tube; and, the spindle shaft is constructed as a hollow shaft by way of which the tool mounting section constructed for mounting a diaphragm chuck tool, can be acted on by a fluid.

2. A device according to claim 1 further characterized by the spindle housing comprising a motor housing, in which the rotor and the stator of the rotary drive are arranged, and a shaft housing, which is flange-mounted to the motor housing and in which the spindle shaft is rotatably mounted.

3. A device according to claim 2 further characterized by the motor housing being closed by a cover having a passage bore in which a rotary leadthrough for the fluid is fastened, the leadthrough being in fluid connection with the hollow spindle shaft.

4. A device according to claim 3 further characterized by the rotary leadthrough being frictionally fixed in the passage bore of the cover by a resilient cable leadthrough bush.

5. A device according to claim 4 further characterized by a bellows surrounding the spindle housing and being arranged between the end of the guide tube remote from the rotary drive and the end of the spindle housing remote from the rotary drive.

6. A device according to claim 5 further characterized by a centrifuging disc for a liquid fine processing medium being mounted on the end of the spindle shaft remote from the rotary drive.

7. A device according to claim 6 further characterized by the spindle housing being axially guided in the guide tube by a slide ring.

8. A device according to claim 3 further characterized by a bellows surrounding the spindle housing and being arranged between the end of the guide tube remote from the rotary drive and the end of the spindle housing remote from the rotary drive.

9. A device according to claim 8 further characterized by a centrifuging disc for a liquid fine processing medium being mounted on the end of the spindle shaft remote from the rotary drive.

10. A device according to claim 9 further characterized by the spindle housing being axially guided in the guide tube by a slide ring.

11. A device according to claim 2 further characterized by a bellows surrounding the spindle housing and being arranged between the end of the guide tube remote from the rotary drive and the end of the spindle housing remote from the rotary drive.

12. A device according to claim 11 further characterized by a centrifuging disc for a liquid fine processing medium being mounted on the end of the spindle shaft remote from the rotary drive.

13. A device according to claim 12 further characterized by the spindle housing being axially guided in the guide tube by a slide ring.

14. A device for fine processing of optically active surfaces of spectacle lenses comprising a spindle shaft, which has a tool mounting section and which is mounted in a spindle housing to be rotatable about a tool axis of rotation, and an electric rotary drive, which comprises a rotor and a stator and by which the spindle shaft operatively connected with the rotor is drivable to rotate about the tool axis of rotation, and the tool mounting section is axially displaceable in the direction of the tool axis of rotation, said device being characterized in that the rotor and the stator of the electric rotary drive and the spindle shaft are coaxially arranged in the spindle housing, which in turn is guided in a guide tube to be capable of defined axial displacement in the direction of the tool axis of rotation wherein the spindle shaft is constructed as a hollow shaft by way of which the tool mounting section constructed for mounting a diaphragm chuck tool, can be acted on by a fluid; and a bellows surrounding the spindle housing and being arranged between the end of the guide tube remote from the rotary drive and the end of the spindle housing remote from the rotary drive.

15. A device according to claim 1 further characterized by a centrifuging disc for a liquid fine processing medium being mounted on the end of the spindle shaft remote from the rotary drive.

16. A device for fine processing of optically active surfaces of spectacle lenses comprising a spindle shaft, which has a tool mounting section and which is mounted in a spindle housing to be rotatable about a tool axis of rotation, and an electric rotary drive, which comprises a rotor and a stator and by which the spindle shaft operatively connected with the rotor is drivable to rotate about the tool axis of rotation, and the tool mounting section is axially displaceable in the direction of the tool axis of rotation, said device being characterized in that the rotor and the stator of the electric rotary drive and the spindle shaft are coaxially arranged in the spindle housing, which in turn is guided in a guide tube to be capable of defined axial displacement in the direction of the tool axis of rotation, wherein the spindle shaft is constructed as a hollow shaft by way of which the tool mounting section constructed for mounting a diaphragm chuck tool, can be acted on by a fluid; and the spindle housing being axially guided in the guide tube by a slide ring.

17. A polishing machine for simultaneous polishing of two spectacle lenses comprising:

a machine housing bounding a work space, two workpiece spindles, which project into the work space and by way of which two spectacle lenses to be polished are drivable to rotate about substantially mutually parallel extending workpiece axes of rotation by a common rotary drive, a first linear drive unit, by which a first tool carriage is movable along a linear axis extending substantially perpendicularly to the workpiece axes of rotation, a pivot drive unit, which is arranged on the first tool carriage and by which a pivot yoke is pivotable about a pivot setting axis extending substantially perpendicularly to the workpiece axes of rotation and substantially perpendicularly to the linear axis, a second linear drive unit, which is arranged on the pivot yoke and by which the at least one second tool carriage is movable along a linear setting axis extending substantially perpendicularly to the pivot setting axis, and two devices for fine processing of optically active surfaces of spectacle lenses comprising a spindle shaft, which has a tool mounting section and which is mounted in a spindle housing to be rotatable about a tool axis of rotation, and an electric rotary drive, which comprises a rotor and a stator and by which the spindle shaft operatively connected with the rotor is drivable to rotate about the tool axis of rotation and the tool mounting section is axially displaceable in the direction of the tool axis of rotation, wherein the rotor and the stator of the electric rotary drive and the spindle shaft are coaxially arranged in the spindle housing, which in turn is guided in a guide tube to be capable of defined axial displacement in the direction of the tool axis of rotation, wherein the spindle shaft is constructed as a hollow shaft by way of which the tool mounting section constructed for mounting a diaphragm chuck tool, can be acted on by a fluid; said two devices project into the work space by their tool mounting sections each associated with a respective one of the workpiece spindles, the respective spindle housing of which is flange-mounted on the at least one second tool carriage while the respective guide tube is mounted on the pivot yoke, so that the tool axis of rotation of each of said two devices forms together with the workpiece axis of rotation of the associated workpiece spindle a plane in which the respective tool axis of rotation is axially displaceable and tiltable with respect to the workpiece axis of rotation of the associated workpiece spindle.

18. A polishing machine according to claim 17, wherein only one second tool carriage is provided for a common axial movement of the two spindle housings by the second linear drive unit.

19. A polishing machine according to claim 18, wherein each of the pivot drive unit and the second linear drive unit is a linear module with a stroke rod movable in and out by way of a spindle drive driven by a direct-current motor.

20. A polishing machine according to claim 17, wherein each of the pivot drive unit and the second linear drive unit is a linear module with a stroke rod movable in and out by way of a spindle drive driven by a direct-current motor.

* * * * *